United States Patent [19]

Somann

[11] 4,083,088

[45] Apr. 11, 1978

[54] STRAP CONNECTOR BUCKLE

[76] Inventor: Gert P. Somann, 745 Inverness Avenue, London, Ontario, Canada

[21] Appl. No.: 549,804

[22] Filed: Feb. 13, 1975

Related U.S. Application Data

[62] Division of Ser. No. 492,848, Jul. 29, 1974, Pat. No. 3,924,302.

[30] Foreign Application Priority Data

Jan. 8, 1974 Canada ..... 189673

[51] Int. Cl.[2] ..... A44B 11/00

[52] U.S. Cl. ..... 24/74 A

[58] Field of Search ..... 24/74 A, 26, 198

[56] References Cited

U.S. PATENT DOCUMENTS

| | | | |
|---|---|---|---|
| 3,377,666 | 4/1968 | Sherman | 24/74 A X |
| 3,624,868 | 12/1971 | Somann | 24/74 A |

*Primary Examiner*—Werner H. Schroeder
*Assistant Examiner*—Peter Nerbun
*Attorney, Agent, or Firm*—Cushman, Darby & Cushman

[57] ABSTRACT

A strap connector buckle formed from a single piece of wire includes spaced pairs of strap engaging arms and means to prevent spreading apart of said arms under tension forces exerted by the strap. In one version, a bend or elbow portion in the wire transmits tension forces from one arm to the other to prevent spreading of said arms while in a second version, interlocking bights of the wire transmit tension forces and thus resist any tendency towards spreading of said arms.

7 Claims, 9 Drawing Figures

STRAP CONNECTOR BUCKLE

This is a divisional of co-pending application Ser. No. 492,848 filed July 29, 1974 now U.S. Pat. No. 3,924,302.

This invention relates to an improved strap connector buckle for securing opposing ends of a flexible strap which is tensioned and arranged around a package, bale, box or bundle or other object that is to be tied or secured.

In recent years, non-metallic strapping, such as nylon, polypropelene, rayon and the like particularly in band or strap configuration, has become increasingly popular. In turn, there has been a demand for specialized fasteners or buckles for securing and tensioning the opposite ends of band or strap loops by means of frictional engagement rather than by means of strapping and sealing tools. Such fasteners or buckles, in order to be effective, must not only grip the band or strap and hold it securely, but also must be arranged such that the band or strap can easily be threaded thereinto by unskilled persons without the use of specialized tools.

In recent years, a number of connector buckle designs have evolved all of which consist of a single length of steel wire appropriately shaped. Unfortunately, in most of these designs, problems have arisen as a result of distortion occurring in the buckle under heavy tension well below the breaking point of the strapping being used. This distortion tends to destroy the parallel arrangement between the pairs of strap engaging arms at the opposite sides of the connector buckle and thus reduces the frictional hold which the buckle has on the plastic strapping thus causing slippage and hence some loosening of the strapping about the package or object which is tied.

It is an object of the present invention to provide improved connector buckles designed and arranged in such a way as to strongly resist the tendency for the arms to be pulled out of parallelism under the influence of the forces applied thereto by the taut strapping.

Thus, in accordance with one aspect of the invention there is provided a strap connector buckle formed of a single piece of wire, said connector buckle being approximately rectangular in outline and comprising a pair of strap engaging arms on each of two opposing sides of the connector buckle, the arms of each pair comprising a first arm and a second arm which are generally straight and approximately parallel to one another and to the first and second arms of the opposing pair and being spaced apart sufficiently to permit the strap with which the connector buckle is to be used to be passed therebetween, the first arm of each of said pairs being a terminal portion of the wire and having a free end and the second arm of each pair being an intermediate wire segment, a first run of the wire connecting the first arm of the first pair to the second arm of the second pair, a second run of the wire connecting the second arm of the first pair to the first arm of the second pair and a further run of the wire connecting the second arms of each pair to one another, and wherein the first run of wire has an end portion thereof adjacent the first arm of the first pair provided with an elbow portion extending around said second arm of the first pair sufficiently as to permit strap tension forces tending to spread said second arms apart to be transmitted from one of said second arms to the other via said first run of wire whereby to resist the spreading apart of said second arms.

In accordance with a further aspect of the invention, the above elbow portion comprises a bend in the end portion of the first run of wire, the bend being located adjacent that end of the second arm to which said second run of wire is attached.

By virtue of the above described arrangement, strap tension forces are effectively transmitted in between said second arms and thus resisting any tendency for the same to be spread apart and thrown out of parallelism by virtue of the strap tension forces.

In a further feature of the invention, the above mentioned free ends of the first arms are arranged to engage and be supported by said further run of wire when the connector strap is under tension. Thus, under heavy tension forces, the free ends of the first arms contact the further run of wire thus preventing further distortion of such first arms under tension and further assisting in maintaining the desired parallelism of the arms.

The invention will now be described by way of examples with reference being had to the accompanying drawings in which.

Figure 1:
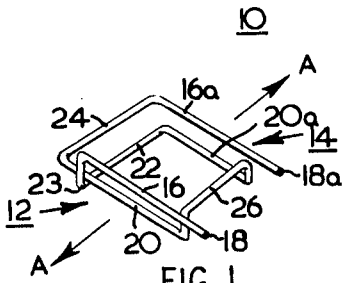
FIG. 1 is a perspective view of one embodiment of the strap connector buckle.
Figure 2:
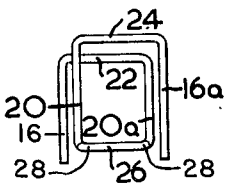
FIG. 2 is a plan view of the buckle of FIG. 1.
Figure 3:
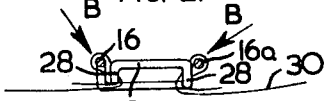
FIG. 3 is an end view of the embodiment of FIG. 1 illustrating diagrammatically the manner in which a strap is laced to the buckle.

With reference now to the first embodiment of the invention as shown in FIGS. 1–3, there is shown a strap connector buckle 10 formed from a single piece of round wire appropriately bent to the desired shape. It will be seen that the connector buckle is approximately rectangular in outline and includes a first and second pair of strap engaging arms 12 and 14 on the opposing sides of the connector buckle. It will also be seen that the arms of each pair are generally straight and approximately parallel to one another and to the arms of the opposing pair, the arms being spaced apart sufficiently to permit the connector strap with which the connector buckle is to be used to be passed therebetween. It will also be seen that the first arms 16, **16*a* of each of said pairs of said arms 12 and 14 constitute terminal portions of the wire having free ends 18, 18*a*. Furthermore, it will be seen that the second arms 20, 20*a* of each pair constitute intermediate wire segments. As shown in the drawings, a first run of the wire 22 connects the first arm 16 of the first pair to the second arm 20*a* of the second pair thereby to define a first generally V-shaped portion. A second run of the wire 24 serves to connect the second arm 20 of the first pair to the first arm 16*a*** of the second pair thereby to define a second generally V-shaped portion and in addition, a further run of the wire 26 connects the second arms 20, 20a of the opposed pairs of arms to one another.

In accordance with an important aspect of the invention, the above mentioned first run of wire 22 has an end portion thereof 23 adjacent the point of connection to the first arm 16 provided with a generally right angled elbow portion which extends around a portion of the second arm 20 sufficiently as to permit strap tension forces which are directed outwardly in the direction of arrows A in FIG. 1 to be transmitted from one of the second arms 20 to the other second arm 20a via the first run of wire 22 whereby to resist any tendency towards spreading apart of arms 20, 20a.

It will be seen that the elbow portion 23 comprises a simple but relatively sharp bend in the first run of wire 22 adjacent one end thereof, the bend 23 being located adjacent that end of the second arm 20 to which the second run of wire 24 is attached. Thus, under the influence of strap tension forces on the second arms 20, 20a, the right angle bend portion 23 comes into contact with the second arm 20 thus transmitting forces thereto and resisting the tendency towards spreading.

As a general observation with reference to FIGS. 1 and 3, it will be noted that the first arms 16, 16a of the opposed pairs 12 and 14 are located on the upper sides of the buckle 10, when in use, while the second arms 20, 20a are located on the under side of the buckle. It will also be noted with particular reference to FIGS. 1 and 3 that the further run of wire 26 includes an upstanding elbow 28 at each of its opposed ends. Thus, an intermediate portion 29 of the further run of wire 26 is disposed above the level of the second arms 20, 20a. It will also be noted with reference to FIGS. 1 and 2 that the free ends 18, 18a of the first arms 16, 16a extend beyond the further run of wire 26. Under the influence of strap tension forces on the arms, when the strap has been properly threaded to the buckle, as will be described, the free ends of the first arms deflect downwardly and inwardly as shown by arrows B in FIG. 3. Thus, such free ends of the arms come into contact with the further run of wire 26 adjacent elbows 28 and are supported thereby thus preventing further undue distortion of the first arms and loss of parallelism between such arms and the remaining arms of the connector buckle. It is of course to be noted that the further run of wire 26 need not necessarily be provided with the upstanding elbows 28. In the absence of such elbows, the free ends of the first arms will simply be deflected downwardly and inwardly until such time as they contact the further run of wire 26 for support thereby.

With reference to FIG. 3, which illustrates the manner in which the strap is connected to the buckle 10, it will be seen that the free end of the strap 30, which straps or tapes are well known per se in the art, is passed around and under the second arm 20a and thence upwardly and around the first arm of the same pair 16a and thence downwardly between arms 16a and 20a and thence around arm 20a whereby it is firmly sandwiched between the tensioned tape and arm 20a. The other end of tape 30 is brought around the package or bale and is secured to the arms 16 and 20 of the first pair of arms in essentially the same fashion.

Figure 4:
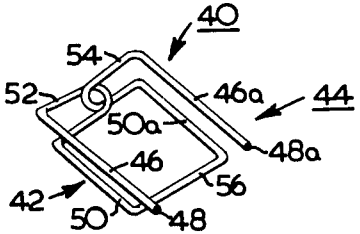
FIG. 4 is a perspective view of another embodiment of the invention as described and claimed in said application Ser. No. 492,848.
Figure 5:
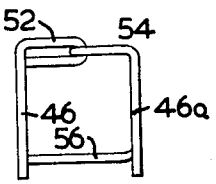
FIG. 5 is a plan view of the embodiment of FIG. 4.
Figure 6:
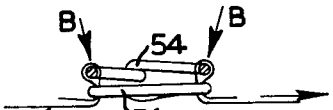
FIG. 6 is an end view of the embodiment of FIG. 4 illustrating diagrammatically how a connector strap is threaded to the buckle.

With reference now to FIGS. 4–6, the subject matter of which is claimed in said application Ser. No. 492,848, there is shown a separate embodiment of the invention which differs from the embodiment of FIGS. 1–3 in a number of important respects. The buckle of FIG. 4 will be designated by the reference numeral 40 and it will be seen that, as with the previous embodiment, it is formed from a single piece of round wire. The connector buckle, as before, is approximately rectangular in outline and includes first and second pairs 42 and 44 of strap engaging arms on opposing sides of the connector buckle. As with the previous embodiment the arms of each pair are generally straight and approximately parallel to one another and to the arms of the opposing pair and they are spaced apart sufficiently as to permit a connector strap with which the connector is to be used to be passed between such arms. A first arm 46, 46a of each of said pairs 42 and 44 constitutes a terminal portion of the wire and they have free ends 48 48a. Furthermore, the second arms 50, 50a of each of the opposed pairs 42 and 44 comprise an intermediate wire segment. In accordance with an important feature of the invention a first bight 52 of the wire serves to connect the first arm 46 of the first pair of arms to one end of the second arm 50 of the first pair. Furthermore, a second bight 54 of the wire serves to connect the first arm 46a of the second pair to one end of the second arm 50a of the second pair. It will be seen that the first and second bights of wire 52 and 54 are interlocked together approximately midway along the end of the connector buckle. That is, in the embodiment of FIGS. 4–6, the bights of wire 52 and 54 are of substantially equal length. By virtue of the fact that the bights of wire 52 and 54 are interlocked together, they are capable of transmitting tension loads and thus they serve to resist any tendency for the second arms 50, 50a of the first and second pairs of arms 42 and 44 to be spread apart under the influence of strap tension forces thereon. It will also be noted from a review of FIGS. 4–6 that a further run of the wire 56 connects the opposite ends of the second arms 50, 50a together, such further run serving basically the same purpose as wire run 26 mentioned in conjunction with the embodiments of FIGS. 1–3.

It will also be noted that when the connector buckle is in use, the free ended first arms 46, 46a are disposed on the upper side while the second arms 50, 50a are disposed on the under side of the buckle. It will also be noted that, as with the embodiment of FIGS. 1–3, that the free ends 48, 48a of the first arms 46, 46a extend outwardly beyond the further run of wire 56 which connects the other end of the second arms 50, 50a together. Thus, under the influence of strap tension forces which cause such free ends 48, 48a to be sprung downwardly in a direction of arrows B as shown in FIG. 6, such free ends engage the further run of wire 56 and are supported thereby thus preventing undue distortion and loss of parallelism between the first arms and said second arms.

The manner in which a connector strap is threaded to the connector buckle of FIG. 4–6 is essentially the same as described in connection with the embodiment of FIGS. 1–3 and need not be repeated here.

Figure 7:
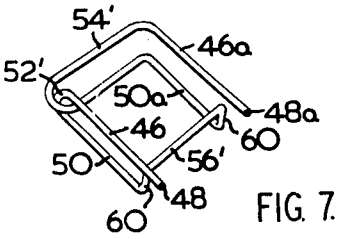
FIG. 7 is a further embodiment of the invention which is similar in many respects to the embodiment of FIG. 4.
Figure 8:
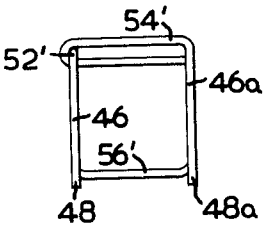
FIG. 8 is a plan view of the embodiment of FIG. 7.
Figure 9:
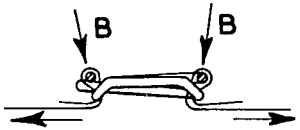
FIG. 9 is an end view of the embodiment of FIG. 7 illustrating diagrammatically how a strap is threaded to the connector buckle.

The embodiments shown in FIGS. 7–9 are a variation of the embodiments of FIGS. 4–6 and thus a full description of this embodiment need not be repeated here. It will be seen that the embodiment of FIGS. 7–9 includes spaced pairs of arms on opposing sides of the connector including free ended first arms 46, 46a and second arms 50, 50a as previously described. The essential difference, however, is that the bights of wire 52', 54' are of unequal length. That is, bight 54' is sufficiently long as to extend across the entire end of the connector buckle so that it interlocks or interloops with the very short bight 52' at one of the corners of the connector buckle. This version of the connector buckle functions as described previously in connection with FIGS. 4–6 to prevent spreading apart of the second arms 50, 50*a* under the influence of tension forces thereon. As a further difference, it will also be noted that the further run of wire 56' which serves to connect the other ends of second arms 50, 50*a* together differs from that shown in connection with FIGS. 4–6. In FIGS. 4–6, the further run of wire 56 is substantially straight whereas in the embodiment of FIGS. 7–9, the opposing ends of the further run of wire are provided with upstanding elbow portions 60 so that the further run of wire 56' assumes a configuration very similar to the configuration of the further run of wire 26 in the embodiment of FIGS. 1–3. Thus, since the free ends 48, 48*a* of first arms 46, 46*a* extend beyond the further run of wire 56', the free ends of such first arms deflect downwardly under the influence of strap tension forces as illustrated by arrows B in FIG. 9 and thus come to rest against the further run of wire 56' adjacent the upstanding elbow portions 60 thereof.

The manner in which the connector strap is threaded to the connector buckle of FIGS. 7–9 is the same as that shown for the embodiments of FIGS. 1–6 and need not be repeated here.

It will thus be seen that the present invention, in its several aspects, provides connector buckle designs which are capable of resisting heavy strap tension forces and serve to maintain the various arms of the connector buckle in substantial parallelism at all times. Thus, the frictional hold which the buckle has on the strapping material is maintained and there is less chance of slippage occurring with resultant loosening of the strapping about the package or object which is to be tied than with prior art designs.

I claim:

1. A strap connector buckle formed of a single piece of wire, said connector buckle being approximately rectangular in outline and comprising a pair of strap engaging arms on each of two opposing sides of the connector buckle, each of said pair of arms comprises a first arm and a second arm, both of which are generally straight and approximately parallel to one another and to the first and second arms of the opposing pair, the first and second arms of each pair being spaced apart sufficiently to permit, in use, a strap with which the connector buckle is to be used to be passed therebetween and said two first arms being spaced apart a distance greater than the distance between said two second arms, the first arm of each of said pairs being a respective terminal portion of the wire and having a free end and the second arm of each pair being an intermediate wire segment, a first run of the wire connecting the first arm of one of said pair to the second arm of the other of said pair, a second run of the wire connecting the second arm of said one pair to the first arm of said other pair and a further run of the wire connecting the second arms of said pairs to one another, and wherein the first run of wire has an end portion thereof adjacent the first arm of said one pair provided with an elbow portion extending partially around said second arm of said one pair to permit strap tension forces tending to spread said second arms apart to be transmitted from one of said second arms to the other of said second arms via said first run of wire to resist the spreading apart of said second arms, said elbow portion comprising a generally right angle bend in said end portion of the first run of wire, said bend being located adjacent to but spaced from that end of the generally straight second arm of said one pair to which said second run of wire is attached, and wherein the free ends of the first arms are arranged to engage and be supported by said further run of wire when said strap is under tension, said further run of wire having an upstanding elbow at each of its ends, said free ends of the first arms tending to come into engagement with said elbows when the strap is tensioned to hold them in approximate parallelism with their associated second arms.

2. A strap connector buckle according to claim 1 wherein said first arms of each pair are located on the upper side of the connector buckle when in use while said second arms are located on the underside of the connector buckle.

3. A buckle for use in connection with flexible strapping comprising a single piece of wire formed as follows:

(a) a first, generally U-shaped portion including a distal leg formed from one end of said single piece of wire, a proximate leg and a bight;

(b) a second, shaped portion including a third leg formed on the other end of the single piece of wire, said third leg and proximate leg lying in a plane;

(c) an intermediate wire portion connecting the proximate leg and third leg while the said distal leg extends to the intermediate wire portion and legs outside the plane but super-adjacent and essentially parallel to the third leg, the improvement comprising;

(d) the intermediate wire portion, which connects the proximate and third legs, extending from the proximate leg through a transitional bend out of said plane, whereby the said transitional bend forms a stop means against which the free end of the distal leg may engage.

4. A strap connector buckle formed of a single piece of wire, said buckle including a pair of strap engaging arms on each of two opposing sides of the connector buckle, each pair of arms comprising a first arm and a second arm both of which are approximately parallel to one another and to the first and second arms of the opposing pair, the first and second arms of each pair being spaced apart sufficiently to permit, in use, a strap with which the connector buckle is to be used to be passed therebetween, the first arm of each pair of arms being a respective terminal portion of the piece of wire and having a free end and the second arm of each pair of arms being an intermediate segment of the piece of wire, a first run of the piece of wire connecting the first arm of one of said pairs to the second arm of the other of said pairs, a second run of the piece of wire connecting the second arm of said one pair to the first arm of said other pair and a further run of the piece of wire connecting the second arms of said pairs to one another, and wherein the free ends of the first arms are arranged to engage and be supported by said further run of the piece of wire when said strap is under tension, said further run of the piece of wire including an upstanding elbow adjacent each of its ends, said free ends of the first arms tending to come into engagement with said further run of the piece of wire at said upstanding elbows when the strap is tensioned, with said upstanding elbows being arranged to hold said first arms in approximate parallelism with their associated second arms under the influence of strap tension forces.

5. A strap connector buckle according to claim 9 wherein said first arms of each pair are located on the upper side of the connector buckle when in use while said second arms are located on the underside of the connector buckle.

6. A buckle for use in connection with flexible strapping comprising a single piece of wire formed to provide:

(a) a first, generally U-shaped portion including a first arm on one side of the buckle and formed from one end of said piece of wire and having a free end, a second arm on the other side of the buckle and a first run of the piece of wire connecting the first arm to the second arm;

(b) a second, shaped portion including a further arm formed from a further segment of the piece of wire, said further arm and said second arm lying generally in a plane;

(c) a further run of the piece of wire connecting the second arm and the further arm while the said first arm lies outside the plane but superadjacent and essentially parallel to the further arm, the improvement comprising:

(d) the further run of the piece of wire which connects the second and further arms extending from the second arm through an elbow portion out of said plane, whereby the said elbow portion forms a stop means adjacent which the free end of the first arm may engage.

7. A buckle for use in connection with flexible strapping comprising a single piece of wire formed as follows:

(a) a first, generally U-shaped portion including a first arm on one side of the buckle and formed from one end of said piece of wire and having a free end, a second arm on the opposite side of the buckle, and a first run of wire interconnecting the first arm to the second arm, (b) a second, generally U-shaped portion including a further first arm on said opposite side of the buckle and formed from the other end of the piece of wire and having a free end, a further second arm on said one side of the buckle and a second run of wire interconnecting the further first arm to the further second arm;

(c) a further run of wire connecting said second arms of the first and second generally U-shaped portions, the two second arms lying generally in a first plane and the two first arms lying essentially parallel to each other and in a second plane; one of said first and second runs of wire extending from said first plane into said second plane; the improvement wherein:

(d) said further run of wire lies, to a substantial extent, above said first plane and extends down into the first plane near both of its ends to join with the second arms of each generally U-shaped portion respectively, thereby constituting a pair of spaced apart stop means against which each of the free-ends of the first arms may respectively engage.

* * * * *